US009957691B2

(12) United States Patent
Congdon et al.

(10) Patent No.: US 9,957,691 B2
(45) Date of Patent: May 1, 2018

(54) WEAR COMPONENT FOR GROUND ENGAGING TOOL

(71) Applicant: Caterpillar Inc., Peoria, IL (US)

(72) Inventors: Thomas Marshall Congdon, Dunlap, IL (US); Madhukar Maguluru, Peoria, IL (US); Nick William Biggs, Princeville, IL (US)

(73) Assignee: Caterpillar Inc., Peoria, IL (US)

( * ) Notice: Subject to any disclaimer, the term of this patent is extended or adjusted under 35 U.S.C. 154(b) by 232 days.

(21) Appl. No.: 14/446,095

(22) Filed: Jul. 29, 2014

(65) Prior Publication Data

US 2016/0032559 A1 Feb. 4, 2016

(51) Int. Cl.
*E02F 3/815* (2006.01)

(52) U.S. Cl.
CPC ..... *E02F 3/8152* (2013.01)

(58) Field of Classification Search
CPC ..... E02F 3/8152
USPC ..... 172/701.2, 701.3
See application file for complete search history.

(56) References Cited

U.S. PATENT DOCUMENTS 1,633,057 A 6/1927 Wold
2,866,280 A * 12/1958 O'Connor ..... E02F 3/8152 172/701.3
2,887,797 A * 5/1959 O'Connor ..... E02F 3/815 172/701.3
2,965,989 A * 12/1960 Hibbard ..... E02F 3/8152 172/701.2
3,021,626 A 2/1962 Paul
3,289,331 A * 12/1966 Freeman ..... E02F 3/8152 144/34.1
3,456,370 A * 7/1969 Gilbertson ..... E02F 3/8152 172/701.2

(Continued)

FOREIGN PATENT DOCUMENTS

AU 2003235000 B2 9/2003
CA 2445795 1/2004

(Continued)

OTHER PUBLICATIONS

ESCO Blade Products, ESCO Corporation, 2009, 16 pages.

(Continued)

*Primary Examiner* — Thomas B Will
*Assistant Examiner* — Joel F. Mitchell
(74) *Attorney, Agent, or Firm* — Finnegan, Henderson, Farabow, Garrett & Dunner, LLP

(57) ABSTRACT

A wear component for a ground engaging tool includes a mounting portion having a first surface, a second surface, and a thickness between the first surface and the second surface. The mounting portion is connectable to a mounting assembly of the ground engaging tool. The wear component also includes at least one wear portion connected to the mounting portion and forming at least one ground engaging edge. The at least one wear portion has at least one first surface including at least one groove extending from the at least one ground engaging edge toward the mounting portion, at least one second surface, and at least one thickness between the at least one first surface and the at least one second surface. A maximum of the at least one thickness of the at least one wear portion is larger than a maximum of the thickness of the mounting portion.

12 Claims, 8 Drawing Sheets

(56) References Cited

U.S. PATENT DOCUMENTS

| | | | | | |
|---|---|---|---|---|---|
| 3,465,833 | A * | 9/1969 | Lutz | E02F 3/8152 | 172/701.2 |
| 3,805,423 | A | 4/1974 | Engel et al. | | |
| 3,934,654 | A | 1/1976 | Stephenson et al. | | |
| 4,185,699 | A | 1/1980 | Lewison | | |
| 4,883,129 | A * | 11/1989 | Lonn | E02F 9/285 | 172/701.3 |
| 5,427,186 | A * | 6/1995 | Adrian | E02F 3/8152 | 172/701.3 |
| 5,743,033 | A * | 4/1998 | Gegel | B21K 11/00 | 37/446 |
| 8,479,838 | B1 * | 7/2013 | Biggs | E02F 3/8152 | 172/701.1 |
| 8,602,122 | B2 * | 12/2013 | Congdon | E02F 3/7618 | 172/701.1 |
| 8,783,376 | B2 * | 7/2014 | Congdon | E02F 3/8152 | 172/701.3 |
| 9,243,381 | B2 * | 1/2016 | Behmlander | E02F 3/8152 | |
| 2013/0161031 | A1 | 6/2013 | Biggs et al. | | |
| 2013/0161037 | A1 | 6/2013 | Congdon et al. | | |
| 2014/0041884 | A1 | 2/2014 | Zhu | | |
| 2014/0041886 | A1 | 2/2014 | Congdon et al. | | |

FOREIGN PATENT DOCUMENTS

| | | |
|---|---|---|
| EP | 2369064 | 9/2011 |
| GB | 1 467 326 | 3/1977 |
| JP | 61-124505 | 6/1986 |
| JP | 2001271373 | 10/2001 |
| WO | 0039407 | 7/2000 |

OTHER PUBLICATIONS

U.S. Appl. No. 13/866,394 of Matthew J. Behmlander, entitled "Erosion Monitoring System for Ground Engaging Tool" filed Apr. 19, 2013.

* cited by examiner

WEAR COMPONENT FOR GROUND ENGAGING TOOL

TECHNICAL FIELD

The present disclosure relates generally to a wear component, and more particularly, to a wear component for a ground engaging tool.

BACKGROUND

Machines, for example motor graders, dozers, when loaders, and excavators are commonly used in material moving applications. These machines include a ground engaging tool having a cutting edge component configured to contact the material. For example, motor graders are typically used to perform displacement, distribution and leveling of material, such as rock and/or soil. The motor graders may move the ground engaging tool over the ground so that the cutting edge component engages with the rock and/or soil so as to displace, distribute, or level the rock and/or soil.

During use of the cutting edge component, the material may abrade the cutting edge component, causing it to erode away. Accordingly, the cutting edge component may be removably attached to the ground engaging tool and replaced on a periodic basis. Conventional cutting edge components may be formed as a single plate of constant thickness. Such conventional cutting edge components may be relatively costly to manufacture and relatively difficult to handle due to their weight.

An alternative cutting edge component is described in U.S. Pat. No. 1,633,057 (the '057 patent) issued to Wold. Specifically, the cutting edge component of the '057 patent includes an upper portion of about one-half thickness as a lower portion. By reducing the thickness of the upper portion, the cutting edge component may require less material and may weigh less than the conventional cutting edge component having a single plate of constant thickness. However, the cutting edge component of the '057 patent may still be relatively costly to manufacture and relatively difficult to handle due to its weight. Also, the cutting edge component may not efficiently direct material, such as rock and/or soil, around the cutting edge component.

The disclosed system is directed to overcoming one or more of the problems set forth above.

SUMMARY

In one aspect, the present disclosure is directed to a wear component for a ground engaging tool. The wear component includes a mounting portion having a first surface, a second surface opposite the first surface, and a thickness between the first surface and the second surface of the mounting portion. The mounting portion is connectable to a mounting assembly of the ground engaging tool. The wear component also includes at least one wear portion connected to the mounting portion and forming at least one ground engaging edge. The at least one wear portion has at least one first surface, at least one second surface opposite the at least one first surface, and at least one thickness between the at least one first surface and the at least one second surface of the at least one wear portion. A maximum of the at least one thickness of the at least one wear portion is larger than a maximum of the thickness of the mounting portion. The at least one first surface of the at least one wear portion includes at least one groove extending from the at least one ground engaging edge toward the mounting portion.

In another aspect, the present disclosure is directed to a wear component for a ground engaging tool. The wear component includes a mounting portion having a first surface, a second surface opposite the first surface, and a thickness between the first surface and the second surface of the mounting portion. The mounting portion is connectable to a mounting assembly of the ground engaging tool. The wear component also includes at least one wear portion connected to the mounting portion and forming at least one ground engaging edge. The at least one wear portion has at least one first surface, at least one second surface opposite the at least one first surface, and at least one thickness between the at least one first surface and the at least one second surface of the at least one wear portion. The thickness of the mounting portion tapers substantially continuously from a first end of the mounting portion to a second end of the mounting portion. The at least one thickness of the at least one wear portion tapers substantially continuously from at least one first end of the at least one wear portion to the respective at least one ground engaging edge.

In another aspect, the present disclosure is directed to a wear component for a ground engaging tool. The wear component including a mounting portion connectable to a mounting assembly of the ground engaging tool. The wear component also includes at least one wear portion connected to the mounting portion and forming at least one ground engaging edge. The at least one wear portion includes at least one groove extending from the ground engaging edge toward the mounting portion. The at least one groove is coated with an abrasion resistant material.

DETAILED DESCRIPTION

Reference will now be made in detail to exemplary embodiments, which are illustrated in the accompanying drawings. Wherever possible, the same reference numbers will be used throughout the drawings to refer to the same or like parts.

Figure 1:
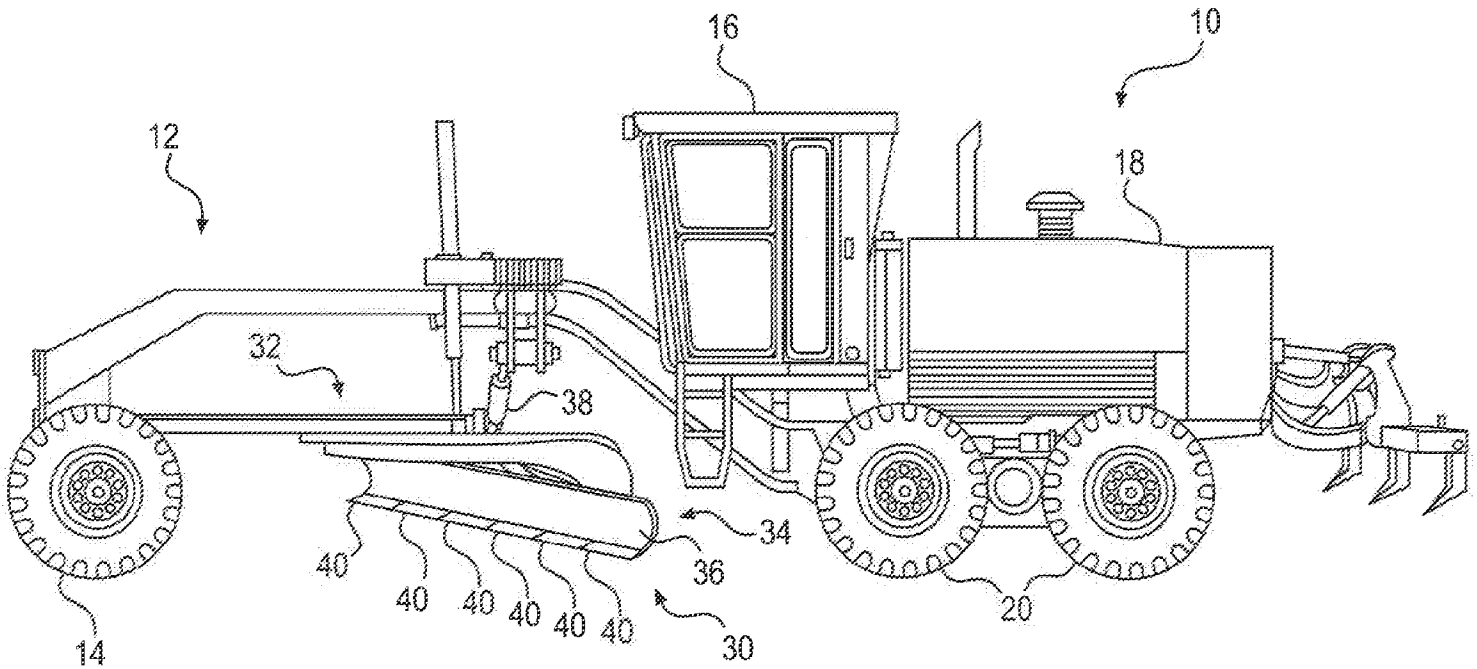
FIG. 1 is a side view of a machine, according to an exemplary embodiment.

An exemplary embodiment of a machine 10 is illustrated in FIG. 1. The machine 10 may be, for example, a motor grader, a backhoe loader, an agricultural tractor, a wheel loader, a skid-steer loader, a dozer, an excavator, or any other type of machine known in the art. As a motor grader, the machine 10 may include a frame assembly 12. The frame assembly 12 may include a pair of front wheels 14 (or other traction devices) and may support an operator station 16. The frame assembly 12 may also include one or more compartments 18 for housing a power source (e.g., an engine) and associated cooling components. The power source may be operatively coupled to one or more pairs of rear wheels 20 (or other traction devices) for propulsion of the machine 10.

The machine 10 may also include one or more ground engaging tools 30. The ground engaging tool(s) 30 may include one or more wear components, such as one or more cutting edge components 40. In the case of a motor grader, as shown in FIG. 1, the ground engaging tool 30 may include a plurality of the cutting edge components 40 (e.g., six cutting edge components). Alternatively, other numbers of cutting edge components 40 may be provided, such as from one to eight cutting edge components, depending on the application.

In the embodiment of the motor grader shown in FIG. 1, the ground engaging tool 30 may include a drawbar-circle-moldboard (DCM) assembly 32 with a moldboard assembly 34 (or other mounting assembly) including a support surface 36. The cutting edge components 40 may be removably attached to the support surface 36. The DCM assembly 32 may be operatively connected to and supported by the frame assembly 12 or by another portion of the machine 10. The DCM assembly 32 may control the movement of the moldboard assembly 34 and therefore also the movement of the cutting edge components 40 mounted to the support surface 36 of the moldboard assembly 34. The DCM assembly 32 may also be supported by a hydraulic ram assembly 38 that controls the movement of the DCM assembly 32. As a result, the DCM assembly 32 and/or the hydraulic ram assembly 38 may control one or more of a vertical, horizontal, or pivotal movement of the moldboard assembly 34 and the cutting edge components 40 mounted to the support surface 36 of the moldboard assembly 34. Alternatively, different mechanical and/or hydraulic arrangements, e.g., other than the DCM assembly 32 and/or hydraulic ram assembly 38 described above, may be provided to allow for movement of the cutting edge components 40.

Figure 3:
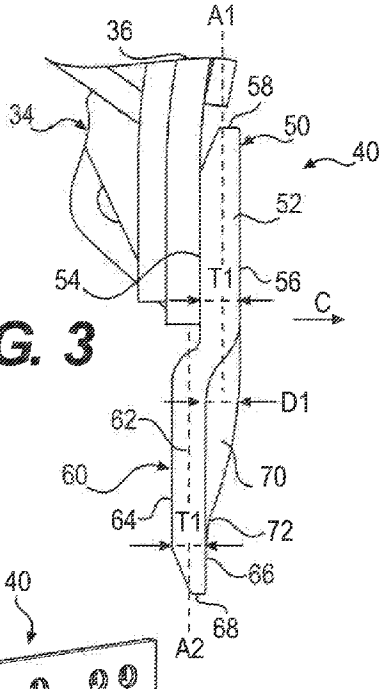
FIG. 3 is a side view of the cutting edge component and the moldboard assembly of FIG. 2.
Figure 4:
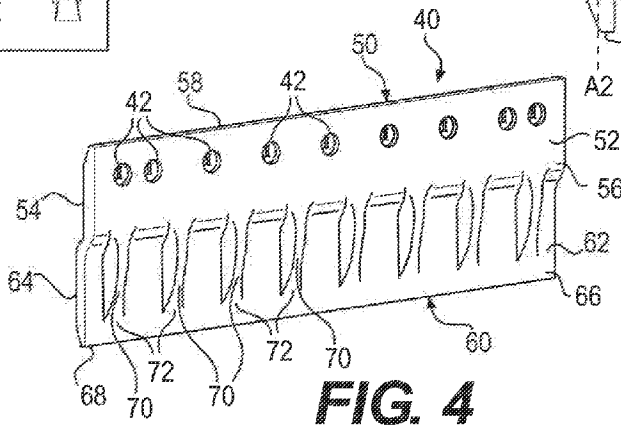
FIG. 4 is a perspective view of the cutting edge component of FIG. 2.
Figure 2:
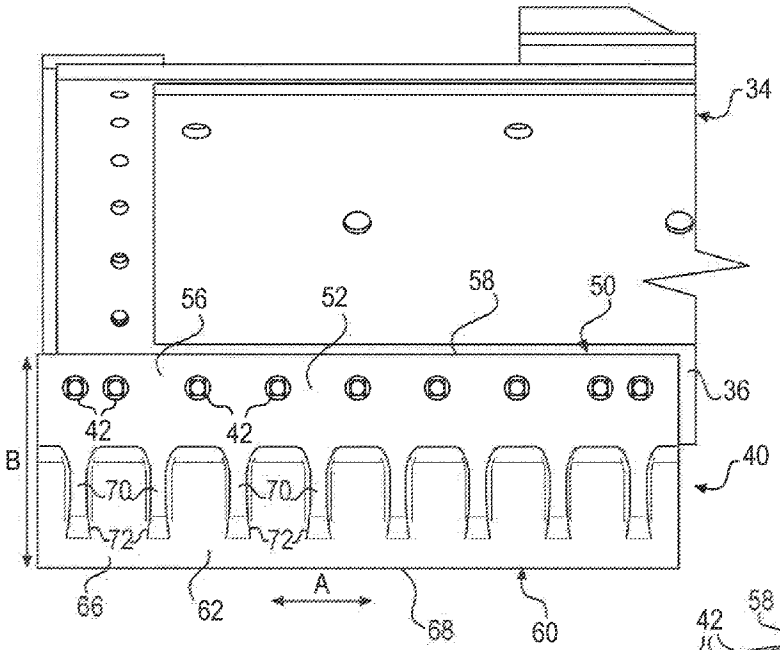
FIG. 2 is a front view of a cutting edge component connected to a moldboard assembly of the machine of FIG. 1.

FIGS. 2-4 show an exemplary embodiment of the cutting edge component 40. The term "longitudinal" refers to a dimension generally lengthwise with respect to the cutting edge component 40, as indicated by the arrow A in FIG. 2. The term "lateral" refers to a dimension generally extending between a proximal end or proximal edge 58 and a ground engaging edge 68 of the cutting edge component 40, as indicated by the arrow B in FIG. 2. The proximal edge 58 and the ground engaging edge 68 may extend generally longitudinally as shown. In an embodiment, the length of the cutting edge component 40 along the longitudinal direction may range from approximately 24 inches to approximately 92 inches, and the length of the cutting edge component 40 along the lateral direction may range from approximately 8 inches to approximately 16 inches. In one embodiment, the cutting edge component 40 may be approximately 48 inches longitudinally and approximately 16 inches laterally.

The terms "distal" and "proximal" are used herein to refer to the relative positions of the components of the exemplary cutting edge components along the lateral dimension. When used herein, "distal" refers to one end of the cutting edge component 40 in the lateral dimension, e.g., positioned near the ground engaging edge 68 of the cutting edge component 40. In contrast, "proximal" refers to the end of the cutting edge component 40 that is opposite the distal end in the lateral dimension, e.g., positioned near the proximal edge 58 of the cutting edge component 40.

While the cutting edge component 40 shown in FIGS. 2-4 may be positioned substantially at right angles to the normal direction of travel of the cutting edge component 40, as indicated by the arrow C in FIG. 3, it is to be appreciated that the cutting edge component 40 may be oriented at an angle and/or curved. The terms "front" and "rear" are also used herein to refer to the relative positions of the components of the exemplary cutting edge components. When used herein, "front" refers to one side of the cutting edge component 40, e.g., positioned near the forward side of the cutting edge component 40 with respect to the direction of travel of the machine 10. In contrast, "rear" refers to the side of the cutting edge component 40 that is opposite the front side. The rear side of the cutting edge component 40 may be the side that is connected to or proximal to the support surface 36 of the ground engaging tool 30 to Which the cutting edge component 40 is mounted.

The cutting edge component 40 may be replaceable to help ensure productivity and/or efficiency of the machine 10. For example, the cutting edge component 40 may be removably connected to the support surface 36 of the ground engaging tool 30 by way of one or more fasteners (not shown), such as bolts, inserted through one or more mounting holes 42 in the cutting edge component 40.

The cutting edge component 40 may include one or more mounting portions 50, which may include the mounting holes 42, connected to one or more wear portions 60. The cutting edge component 40 shown in FIGS. 2-4 includes one mounting portion 50 including the proximal edge 58 of the cutting edge component 40 and one wear portion 60 including the ground engaging edge 68 of the cutting edge component 40.

The mounting portion 50 may include a longitudinally-extending substantially planar portion 52 including a rear surface 54, a front surface 56, and the proximal edge 58. As shown in FIG. 3, the rear surface 54 and the front surface 56 may be substantially flat, and the substantially planar portion 52 may taper toward the proximal end of the cutting edge component 40 to form the proximal edge 58. The substantially planar portion 52 may be connectable to the moldboard assembly 34. For example, the substantially planar portion 52 may include the mounting holes 42 for receiving the fasteners (not shown) for attaching the cutting edge component 40 to the support surface 36 of the moldboard assembly 34. As shown in FIG. 3, the rear surface 54 may be configured to contact and abut the support surface 36.

The wear portion 60 may include a longitudinally-extending substantially planar portion 62 including a rear surface 64, a front surface 66, and the ground engaging edge 68. The rear surface 64 and the front surface 66 may be substantially flat, and the substantially planar portion 62 may taper toward the distal end of the cutting edge component 40 to form the ground engaging edge 68. Alternatively, instead of being substantially flat, the substantially planar portion 52 of the mounting portion 50 and/or the substantially planar portion 62 of the wear portion 60 may be substantially curved or may have another type of profile. Also, as shown in FIG. 3, the substantially planar portion 52 of the mounting portion 50 and the substantially planar portion 62 of the wear portion 60 may have a similar and constant thickness T1 (e.g., between the rear surface 54 and the front surface 56, and between the rear surface 64 and the front surface 66) substantially throughout the entire substantially planar portion 52 and the entire substantially planar portion 62 (e.g., except the proximal edge 58, the ground engaging edge 68, the mounting holes 42, and/or any beveled edges). In an embodiment, the minimum of the thickness T1 may range from approximately 10 millimeters to approximately 80 millimeters, e.g., approximately 35 millimeters in one embodiment. Alternatively, the substantially planar portion 52 of the mounting portion 50 and/or the substantially planar portion 62 of the wear portion 60 may have a variable thickness, depending on the application. In an embodiment in which the substantially planar portion 52 and/or the substantially planar portion 62 of have a variable thickness, the thickness of the substantially planar portion 52 of the mounting portion 50 may not exceed the thickness of the substantially planar portion 62 of the wear portion 60.

The mounting portion 50 and the wear portion 60 may be positioned to form a generally S-shaped profile, as shown in FIG. 3. For example, the substantially planar portion 52 of the mounting portion 50 may extend generally laterally along an axis A1 lying midway through the thickness of the substantially planar portion 52, and the substantially planar portion 62 of the wear portion 60 may extend generally laterally along an axis A2 lying midway through the thickness of the substantially planar portion 62. Axes A1 and A2 may be generally parallel and/or offset depthwise, as shown in FIG. 3. Also, the front surface 56 of the substantially planar portion 52 of the mounting portion 50 and the front surface 66 of the substantially planar portion 62 of the wear portion 60 may be generally parallel and/or offset depthwise. Because of the generally S-shaped profile, at least a portion of the wear portion 60 may be laterally aligned underneath the moldboard assembly 34 (e.g., the support surface 36).

The cutting edge component 40 may also include one or more ribs 70. The ribs 70 may be configured to affect a direction of a flow of material passing along the wear portion 60 and may be sized proportionally to the cutting edge component 40 to support the bend in the S-shaped profile of the cutting edge component 40, which may improve the structural integrity of the cutting edge component 40. In the exemplary embodiment shown in FIGS. 2-4, the cutting edge component 40 includes eight ribs 70. Alternatively, fewer or more than eight ribs 70 may be provided. The ribs 70 may project from the front surface 66 of the substantially planar portion 62 of the wear portion 60 and may be longitudinally-spaced. As shown in FIG. 3, the ribs 70 may connect to a distal end of the mounting portion 50 and may extend distally from the mounting portion 50. The ribs 70 may also project from the wear portion 60 such that the ribs 70 are laterally aligned underneath at least a portion of the mounting portion 50. Each rib 70 may have a distal end 72 located near a middle portion of the substantially planar portion 62 of the wear portion 60 in the lateral direction. As shown in FIG. 3, each rib 70 may also have a depth D1 that tapers at the distal end 72.

The maximum of the depth D1 may correspond to the distance between the front surface 56 of the substantially planar portion 52 of the mounting portion 50 and the front surface 66 of the substantially planar portion 62 of the wear portion 60. In an embodiment, the maximum of the depth D1 may be approximately three times the thickness T1 or less. Also, as shown in FIGS. 2-4, the front surface of each rib 70 may be continuous with the front surface 56 of the substantially planar portion 52 of the mounting portion 50 and the front surface 66 of the substantially planar portion 62 of the wear portion 60.

Figure 6:
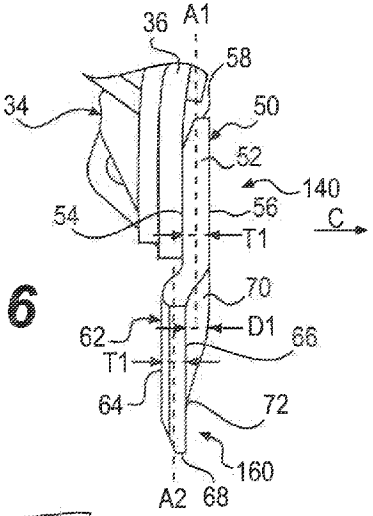
FIG. 6 is amide view of the cutting edge component and the moldboard assembly of FIG. 5.
Figure 5:
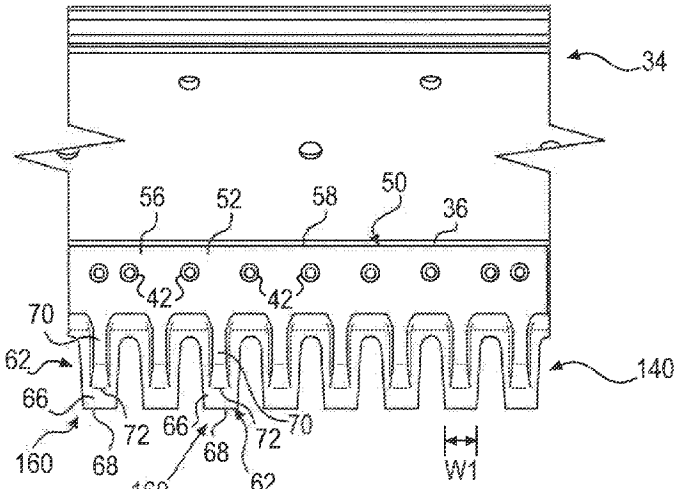
FIG. 5 is a front view of a cutting edge component connected to a moldboard assembly, according to another exemplary embodiment.
Figure 7:
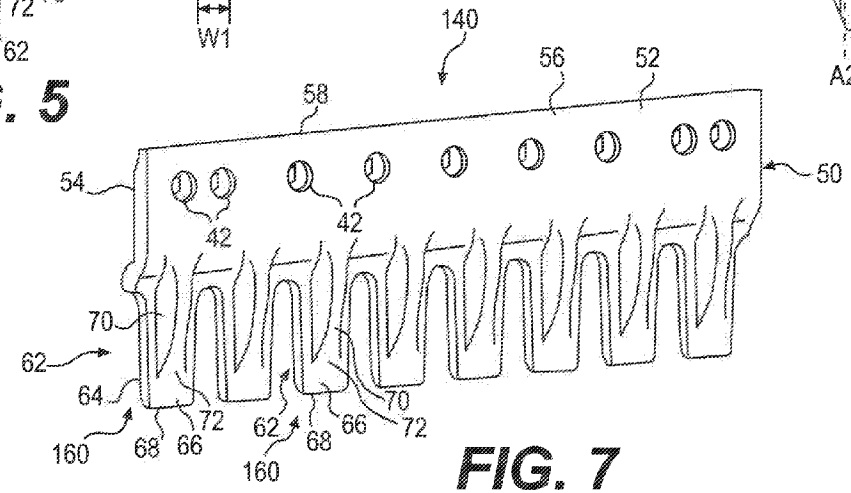
FIG. 7 is a perspective view of the cutting edge component of FIG. 5.

FIGS. 5-7 show a cutting edge component 140, according to another exemplary embodiment. The cutting edge component 140 may be similar to the cutting edge component 40 shown in FIGS. 1-4, with the differences described below.

The cutting edge component 140 may include a plurality of wear portions or teeth 160, instead of the single wear portion 60 of FIGS. 1-4. Each tooth 160 may have similar characteristics as the single wear portion 60 described above. In the exemplary embodiment shown in FIGS. 5-7, the cutting edge component 140 includes eight teeth 160. Alternatively, fewer or more than eight teeth 160 may be provided. The teeth 160 may connect to and be longitudinally-spaced along the distal end of the mounting portion 50. As shown in FIG. 5, each tooth 160 may have a width W1 that may taper from the proximal end of the tooth 160 that connects to the mounting portion 50 toward the respective around engaging edge 68. Each tooth 160 may include one or more of the ribs 70, and in the exemplary embodiment shown in FIGS. 5-7, each tooth 160 includes one rib 70 extending centrally on the tooth 160 with respect to the width W1. Also, as shown in FIG. 6, the rear surface 64 of the teeth 160 may include beveled edges. The ratio of the width W1 of the teeth 160 to a width of a gap between a pair of adjacent teeth 160 may be approximately 3:1 or less (e.g., the width W1 may be equal to or greater than three times the width of the gap).

Figure 9:
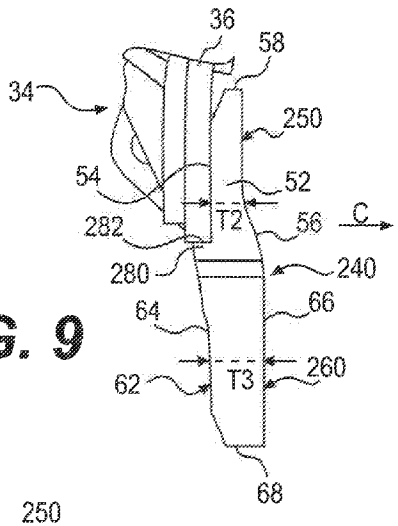
FIG. 9 is aside view of the cutting edge component and the moldboard assembly of FIG. 8.
Figure 8:
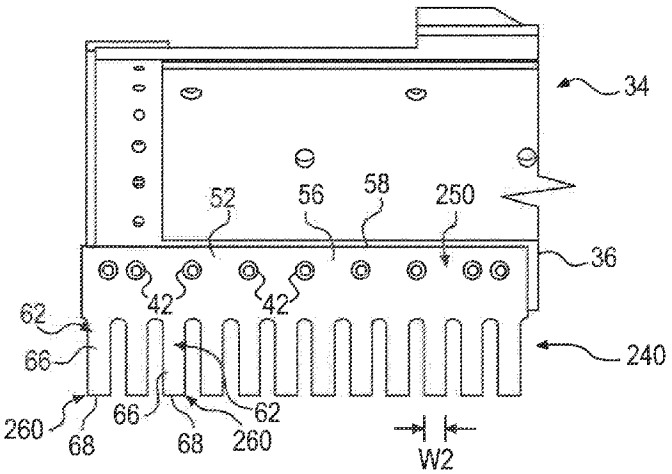
FIG. 8 is a front view of a cutting edge component connected to a moldboard assembly, according to a further exemplary embodiment.
Figure 10:
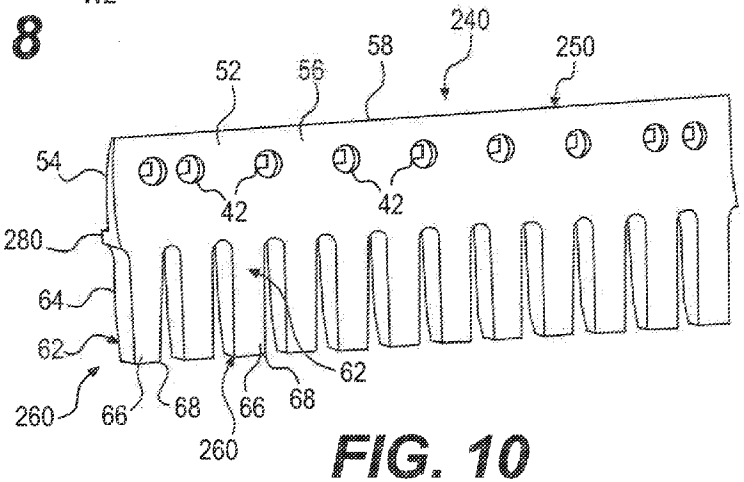
FIG. 10 is a perspective view of the cutting edge component of FIG. 8.

FIGS. 8-10 show a cutting edge component 240, according to another exemplary embodiment. The cutting edge component 240 may be similar to the cutting edge component 140 shown in FIGS. 5-7, with the differences described below.

The cutting edge component 240 may include a mounting portion 250 and a plurality of wear portions or teeth 260. In the exemplary embodiment shown in FIGS. 8-10, the cutting edge component 240 includes twelve teeth 260. Alternatively, fewer or more than twelve teeth 260 may be provided. The teeth 260 may connect to and be longitudinally-spaced along the distal end of the mounting portion 250. As shown in FIG. 5, each tooth 260 may have a width W2 that may taper from the proximal end of the tooth 260 that connects to the mounting portion 50 toward the respective around engaging edge 68.

The mounting portion 250 and the teeth 260 may be similar to the mounting portion 50 and the teeth 160 described above, but may not include the ribs 70 and may have different side profiles, as shown in FIG. 9. For example, the substantially planar portion 52 and the substantially planar portions 62 of the cutting edge component 140 may not have the substantially constant thickness T1 and the cutting edge component 140 may not be generally S-shaped.

As shown in FIG. 9, the substantially planar portion 52 of the mounting portion 250 may have a variable thickness T2 (e.g., between the rear surface 54 and the front surface 56) that tapers from the distal end of the mounting portion 250 that connects to the teeth 260 toward the proximal edge 58, and the substantially planar portion 62 of each tooth 260 may have a variable thickness T3 (e.g., between the rear surface 64 and the front surface 66) that tapers from the proximal end of the tooth 260 that connects to the mounting portion 250 toward the ground engaging edge 68. The tapering of the thicknesses T2 and T3 may be substantially continuous such that the maximum of the thickness T2 of the substantially planar portion 52 of the mounting portion 250 may be located closer to the distal end of the mounting portion 250 (or the teeth 260) than the proximal edge 58, and the maximum of the thickness T3 of the substantially planar portion 62 of each tooth 260 may be located closer their proximal ends (or the mounting portion 250) than the ground engaging edges 68. Thus, the middle portion of the cutting edge component 240 in the lateral direction may be thicker than the proximal edge 58 and the ground engaging edges 68. Also, the maximum of the thickness T3 of each tooth 260 may be larger than the maximum of the thickness T2 of the mounting portion 250, and an average of the thickness T3 of each tooth 260 may be larger than an average of the thickness T2 of the mounting portion 250. In an embodiment, the thickness T2 of the substantially planar portion 52 of the mounting portion 250 may not exceed the thickness T3 of the substantially planar portion 62 of the teeth 260. The thickness T2 and/or the thickness T3 may vary within different ranges between approximately 10 millimeters to approximately 80 millimeters, depending on the application. In an embodiment, the minimum of the thickness T2 may be at least approximately 35 millimeters, e.g., to maintain structural integrity, and a minimum of the thickness T3 may be at least approximately 60 millimeters, e.g., to provide a relatively longer wear life.

Further, at least a portion of the thickness T2 of the mounting portion 250 may extend both rearwardly and forwardly with respect to the location of the proximal edge 58 as the mounting portion 250 becomes thicker toward its distal end. At least a portion of the front surface 56 of the mounting portion 250 may slope forward toward the distal end of the mounting portion 250.

The middle portion of the cutting edge component 140 in the lateral direction may also include a step 280. As shown in FIG. 9, the step 280 may be formed by the rear surface 54 of the substantially planar portion 52 of the mounting portion 250 and a step surface 282, which may be located below the location of the lower edge of the support surface 36 of the moldboard assembly 34 when the cutting edge component 140 is mounted to the support surface 36. In the exemplary embodiment shown in FIGS. 8-10, the step 280 is a right angle. Alternatively, the step surface 282 may form an acute or obtuse angle with respect to the rear surface 54. The step surface 282 may be located at a relatively thicker portion of the mounting portion 250 where the thickness T2 of the mounting portion 250 extends both rearwardly and forwardly with respect to the location of the proximal edge 58.

FIGS. 11-14 show a cutting edge component 340, according to another exemplary embodiment. The cutting edge component 340 may be similar to the cutting edge component 40 shown in FIGS. 1-4, with the differences described below.

Figure 12:
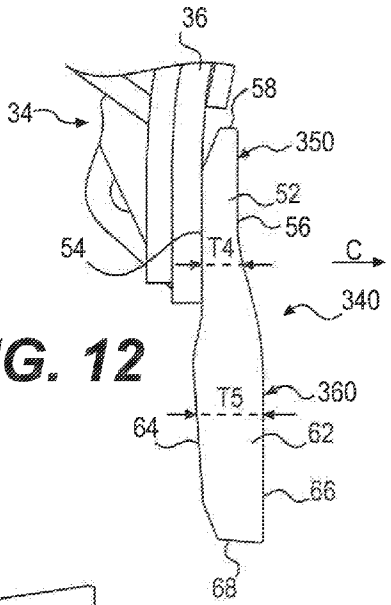
FIG. 12 is a side view of the cutting edge component and the moldboard assembly of FIG. 11.
Figure 13:
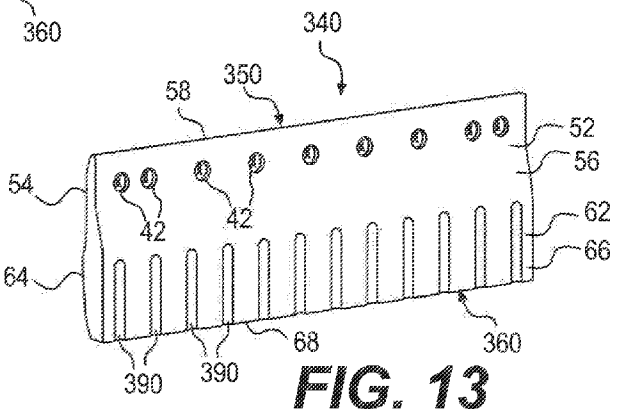
FIG. 13 is a perspective view of the cutting edge component of FIG. 11.

The cutting edge component 340 may include a mounting portion 350 and a wear portion 360. The mounting portion 350 and the wear portion 360 may be similar to the mounting portion 50 and the wear portion 60 described above, but may have different side profiles, as shown in FIG. 12. For example, the substantially planar portion 52 and the substantially planar portions 62 of the cuffing edge component 340 may not have the substantially constant thickness T1, and the cutting edge component 340 may not be generally S-shaped and may not include the ribs 70.

As shown in FIG. 12, the substantially planar portion 52 of the mounting portion 350 may have a variable thickness T4 (e.g., between the rear surface 54 and the front surface 56) that tapers from the distal end of the mounting portion 350 that connects to the wear portion 360 toward the proximal edge 58, and the substantially planar portion 62 of the wear portion 360 may have a variable thickness 75 (e.g., between the rear surface 64 and the front surface 66) that tapers from the proximal end of the substantially planar portion 62 that connects to the mounting portion 350 toward the ground engaging edge 68, The tapering of the thicknesses T4 and T5 may be substantially continuous such that the maximum of the thickness T4 of the substantially planar portion 52 of the mounting portion 350 may be located closer to the distal end of the mounting portion 350 (or the wear portion 360) than the proximal edge 58, and the maximum of the thickness T5 of the substantially planar portion 62 of the wear portion 360 may be located closer the proximal end of the wear portion 360 (or the mounting portion 350) than the ground engaging edge 68. Thus, the middle portion of the cutting edge component 340 in the lateral direction may be thicker than the proximal edge 58 and the ground engaging edge 68. Also, the maximum of the thickness T5 of the wear portion 360 may be larger than the maximum of the thickness T4 of the mounting portion 350, and an average of the thickness T5 of the wear portion 360 may be larger than an average of the thickness 14 of the mounting portion 350. In an embodiment, the thickness T4 of the substantially planar portion 52 of the mounting portion 350 may not exceed the thickness T5 of the substantially planar portion 62 of the wear portion 360. The thickness T4 and/or the thickness T5 may vary within different ranges between approximately 10 millimeters to approximately 80 millimeters, depending on the application. In an embodiment, the minimum of the thickness T4 may be at least approximately 35 millimeters, e.g., to maintain structural integrity, and a minimum of the thickness T5 may be at least approximately 60 millimeters, e.g., to provide a relatively longer wear life.

Further, at least a portion of the thickness 14 of the mounting portion 350 may extend both rearwardly and forwardly with respect to the location of the proximal edge 58 as the mounting portion 350 becomes thicker toward its distal end. At least a portion of the front surface 56 of the mounting portion 350 may slope forward toward the distal end of the mounting portion 350. Also, the maximum of the thickness 75 of the wear portion 360 may be located below the location of the lower edge of the support surface 36 of the moldboard assembly 34 when the cutting edge component 140 is mounted to the support surface 36.

Figure 11:
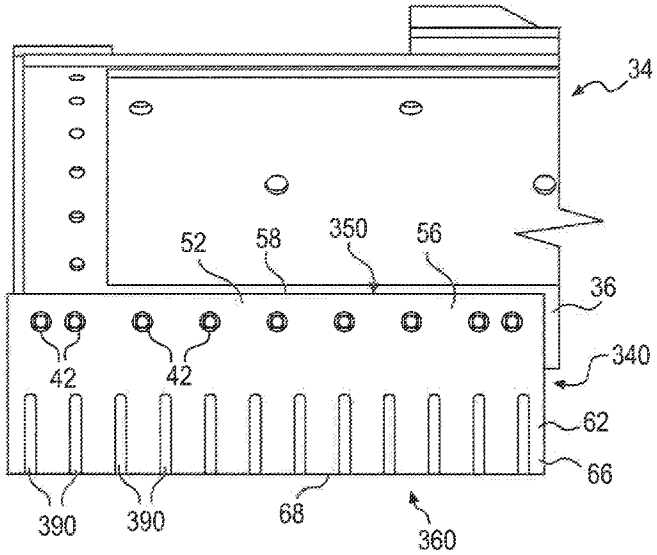
FIG. 11 is a front view of a cutting edge component connected to a moldboard assembly, according to yet another exemplary embodiment.
Figure 14:
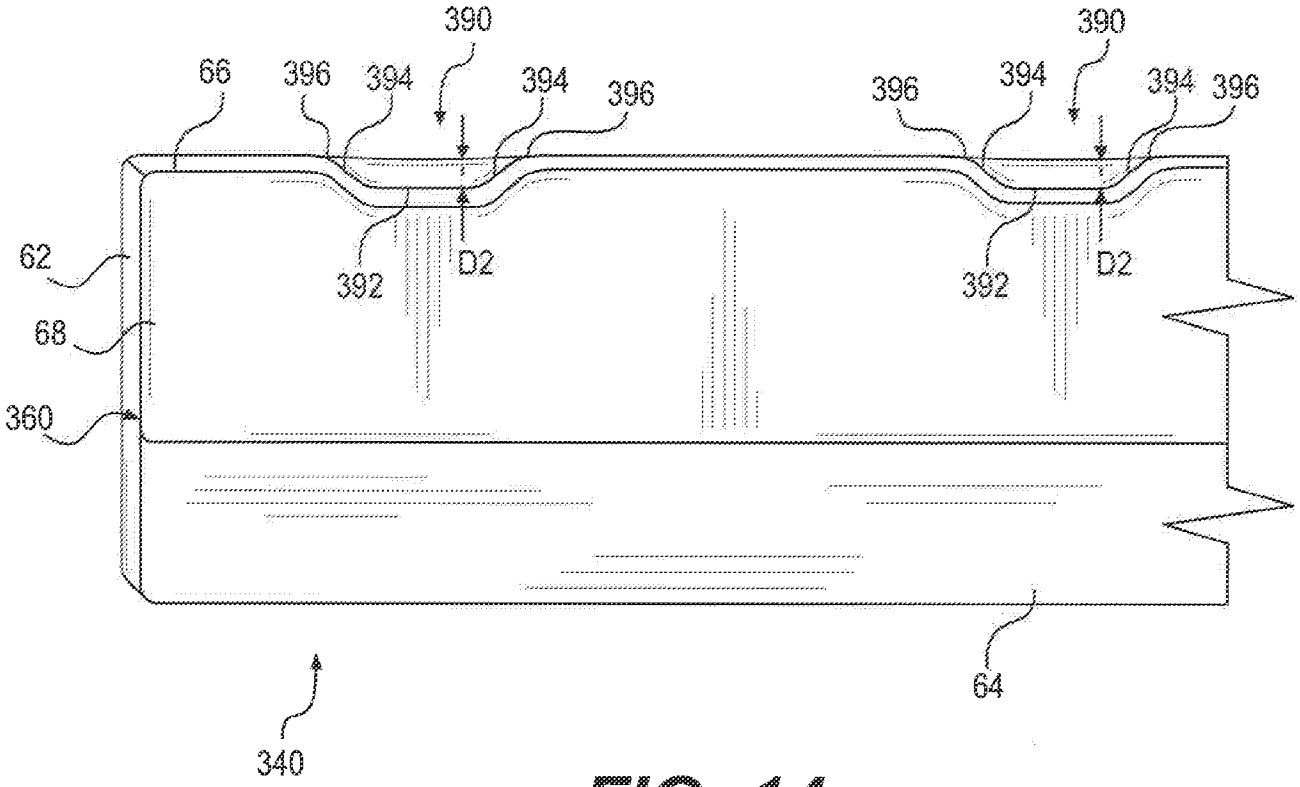
FIG. 14 is a bottom view of the cutting edge component of FIG. 11.

The cutting edge component 340 may also include one or more grooves 390. In the exemplary embodiment shown in FIGS. 11-14, the cutting edge component 340 includes twelve grooves 390. Alternatively, fewer or more than twelve grooves 390 may be provided, Each groove 390 may be provided in the front surface 66 of the substantially planar portion 62 of the wear portion 360. As shown in FIG. 11, each groove 390 may extend proximally from the ground engaging edge 68 toward the mounting portion 350 and may extend along a majority of a lateral length of the wear portion 360. The proximal end of each groove 390 may be located near a middle portion of the cutting edge component 340 in the lateral direction. As shown in FIG. 14, each groove 390 may be generally U-shaped with a bottom surface 392 and sides 394, and may have a depth D2 that may be relatively shallow compared to the thickness T5 of the wear portion 360. The bottom surface 392 may be substantially parallel to the front surface 66 of the substantially planar portion 62 of the wear portion 360. In an embodiment, the depth D2 may be approximately 75% of the thickness T5 (or the maximum of the thickness T5) of the wear portion 360 or less.

The sides 394 of the grooves 390 may form edges 396 with the front surface 66 of the substantially planar portion 62 of the wear portion 360. The edges 396 may serve as self-sharpening teeth as wear progresses on the wear portion 360. For example, the wear portion 360 may wear from the bottom (e.g., starting at the ground engaging edge 68) and then upward (proximally). As the wear portion 360 wears away proximally, unworn and sharpened portions of the edges 396 become exposed, and therefore the edges 396 may be self-sharpening.

The grooves 390 may include a coating of abrasion resistant material. For example, the bottom surface 392, the sides 394, and/or the edges 396 of the grooves 390 may be coated with the abrasion resistant material. The abrasion resistant material may include a carbide (e.g., tungsten carbide, titanium carbide, and/or chromium carbide) and/or a metal oxide (e.g., aluminum oxide and/or chromium oxide). The abrasion resistant material, e.g., in particle form, may be applied to the grooves 390 by welding, plasma transfer arc deposition, and/or laser deposition. In the exemplary embodiment shown in FIG. 14, the coating may not fill in the grooves 390, thereby allowing the grooves 390 to maintain the profile of the bottom surface 392, sides 394, edges 396, and depth D1. Alternatively, the coating may fill the grooves 390.

FIGS. 15-18 show a cutting edge component 440, according to another exemplary embodiment. The cutting edge component 440 may be similar to the cutting edge component 340 shown in FIGS. 11-14, with the differences described below.

Figure 16:
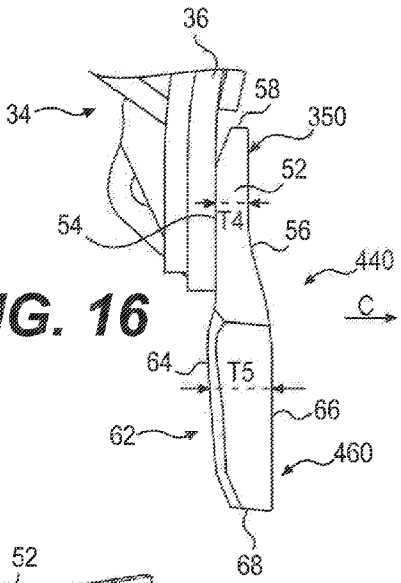
FIG. 16 is a side view of the cutting edge component and the moldboard assembly of FIG. 15.
Figure 15:
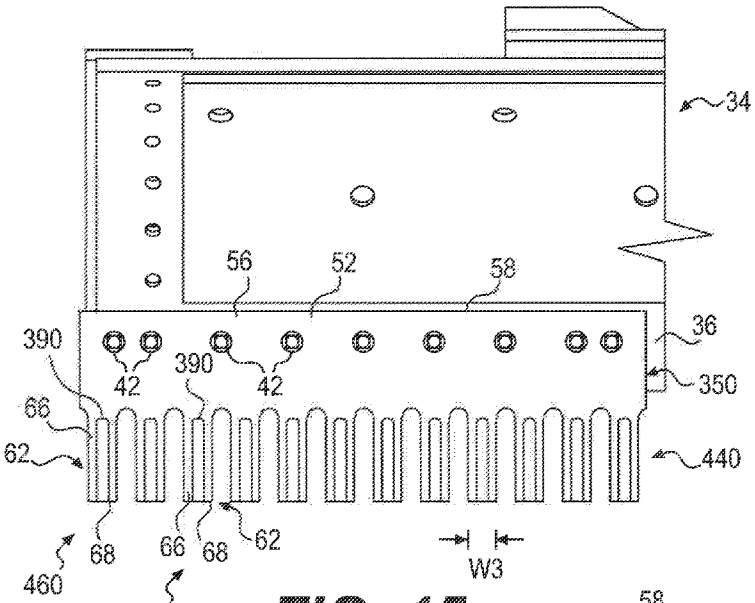
FIG. 15 is a front view of a cutting edge component connected to a moldboard assembly, according to yet a further exemplary embodiment.
Figure 17:
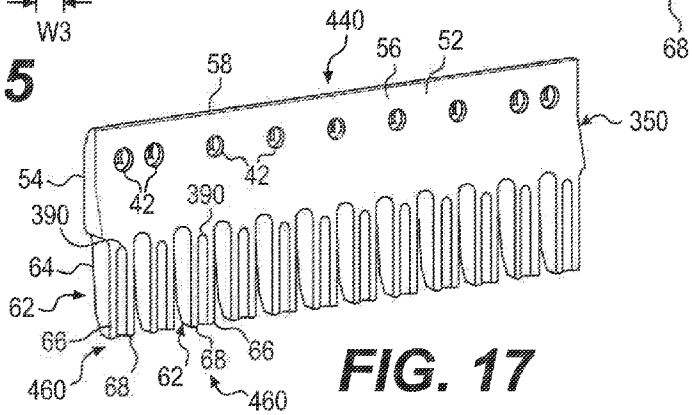
FIG. 17 is a perspective view of the cutting edge component of FIG. 15.

The cutting edge component 440 may include a plurality of wear portions or teeth 460, instead of the single wear portion 360 of FIGS. 11-14. In the exemplary embodiment shown in FIGS. 15-18, the cutting edge component 440 includes twelve teeth 460. Alternatively, fewer or more than twelve teeth 460 may be provided. The teeth 460 may connect to and be longitudinally-spaced along the distal end of the mounting portion 350. As shown in FIG. 15, each tooth 460 may have a width W3 that may taper toward the respective ground engaging edge 68. Each tooth 460 may include one or more of the grooves 390, and in the exemplary embodiment shown in FIGS. 15-18, each tooth 460 includes one groove 390 extending centrally on the tooth 460 with respect to the width W3. Also, as shown in FIG. 16, the rear surface 64 of the teeth 460 may include beveled edges.

Figure 18:
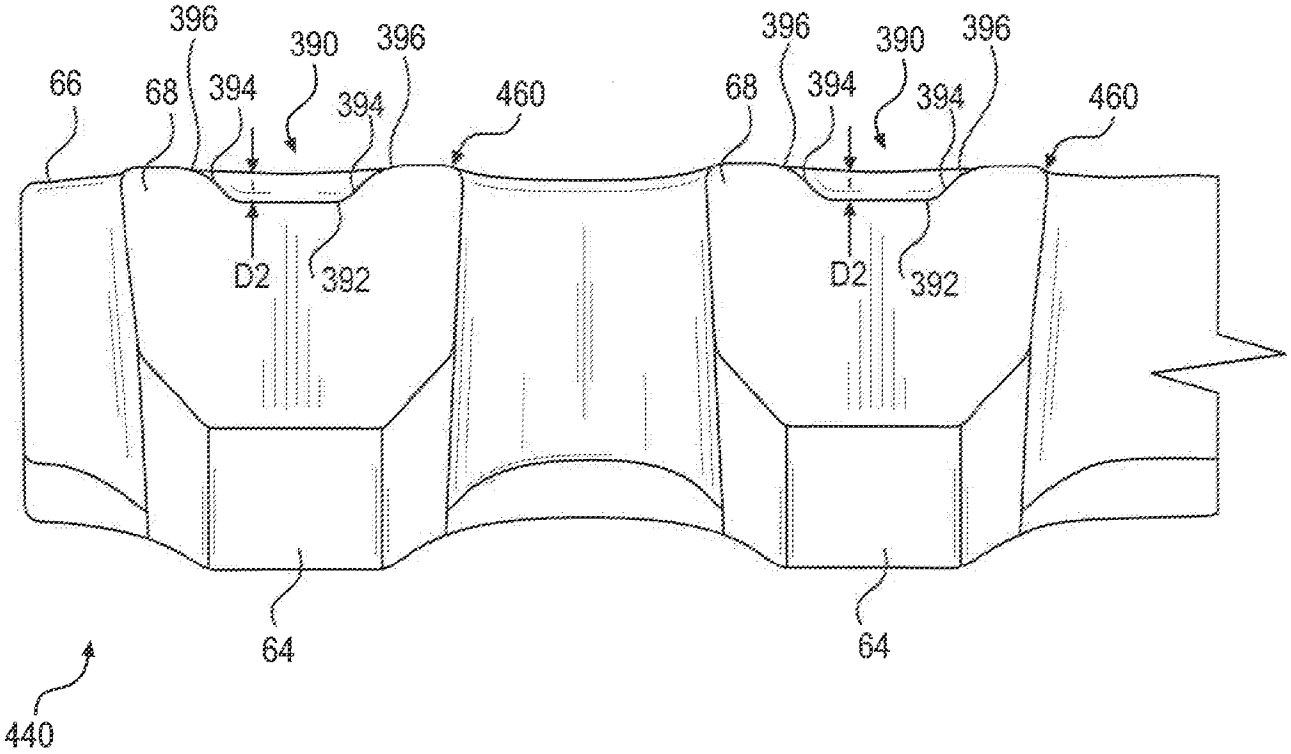
FIG. 18 is a bottom view of the cutting edge component of FIG. 15.

In addition, the teeth 460 may taper toward the rear surface 64, as shown in FIG. 18. The side surfaces of the teeth 460 (extending between the rear surface 64 and the front surface 66) may be at an angle ranging from approximately 0 degrees to approximately 15 degrees relative to a plane that is perpendicular to the front surface 66, The tapering of the teeth 460 toward the rear surface 64 may improve a cutting efficiency of the cutting edge component 440 by reducing drag forces or friction caused by the material flowing against the side surfaces of the teeth 460.

INDUSTRIAL APPLICABILITY

The disclosed cutting edge components may be applicable to any machine having a ground engaging tool. Several advantages may be associated with the cutting edge components. The cutting edge components may exhibit improved performance and longer wear life. For example, the cutting edge components may penetrate and break up hard and/or frozen ground, and may direct the flow of material passing by the cutting edge component when the cutting edge components are moved horizontally and/or vertically into the ground.

The cutting edge components 40, 140, 240, 340, and 440 may have a thickness that tapers toward the distal end of the cutting edge component 40, 140, 240, 340, and 440 to form the ground engaging edge 68, as shown in the side views of FIGS. 3, 6, 9, 12, and 16. Also, the cutting edge components 140, 240, and 440 may include teeth 160, 260, and 460 that have a width (e.g., width W1, W2, and W3) that also tapers toward the distal end of the cutting edge component 140, 240, and 440 to form the ground engaging edge 68, as shown in the front views of FIGS. 5, 8, and 15. The tapering of the width and/or thickness may form a chisel-like member at the ground engaging edge 68 for penetrating and breaking up hard and/or frozen ground, e.g., when the cutting edge components 40, 140, 240, 340, and 440 move horizontally and/or vertically into the ground.

The cutting edge components 140, 240, and 440 may also include teeth 160, 260, and 460 that are spaced to allow the flow of material that is broken up by the ground engaging edge 68 to pass through the teeth 160, 260, and 460. The widths W1, W2, and W3 and spacing of the teeth 160, 260, and 460 may be different depending on the intended function of the cutting edge component 140, 240, and 440. For example, the width of the teeth 160 of the cutting edge component 140 may be wider than the widths W2 and W3 of the teeth 2641 and 460 of the cutting edge components 240 and 440 for structural purposes because the average thickness of the cutting edge component 140 (e.g., thickness T1) may be less than the average thickness (e.g., thickness T2, T3, T4, and T5) of the cutting edge components 240 and 440.

Also, the spacing (e.g., the width of the gaps between the teeth) of the teeth 160 of the cutting edge component 140 may be wider than the spacing of the teeth 260 and 460 of the cutting edge components 240 and 440. For example, the spacing may depend on the size of the particles of the material broken up by the ground engaging edge 68. Because the width W1 and/or spacing of the cutting edge component 140 may be wider than the widths W2 and W3 and/or spacing of the cutting edge components 240 and 440, the cutting edge component 140 may include eight teeth 160 while the cutting edge components 240 and 440 may include twelve teeth 260 and 460.

The cutting edge components 40 and 140 may include the ribs 70 that are configured to adjust a direction of the flow of material that is broken up by the ground engaging edge 68. The flow of material may be directed by the ribs 70 along the wear portion 60 or the teeth 160, over the mounting portion 50, and onto the moldboard assembly 34 where the material may be redirected and cast off to the side of the machine 10. The ribs 70 may also support the bend in the S-shaped profile of the cutting edge component 40, which may improve the structural integrity of the cutting edge component 40 and make the cutting edge component 40 stronger.

The cutting edge components 340 and 440 may include the grooves 390 that include the self-sharpening edges 396 that may assist in penetrating and breaking up hard and/or frozen ground, which may help to reduce the penetration forces required by the cutting edge components 340 and 440. The grooves 390 may also include the coating of abrasion resistant material, which may increase wear life. Thus, the grooves 390 may serve as a location for depositing abrasion resistant material without the need for additional machining. Although not shown, the cutting edge component 240 may also include the grooves 390 and/or the coating of abrasion resistant material.

Also, at least a portion of the thickness T4 of the mounting portions 250 and 350 of the cutting edge components 240 and 340 may extend both rearwardly and forwardly, e.g., with respect to the location of the proximal edge 58, as the mounting portions 250 and 350 become thicker toward the distal end, and at least a portion of the front surface 56 of the mounting portions 250 and 350 may slope forward toward the distal end of the mounting portions 250 and 350. As a result, the flow of material that is broken up by the ground engaging edge 68 may be directed over the front surface 56 of the mounting portions 250 and 350 and onto the moldboard assembly 34 where the material may be redirected and cast off to the side of the machine 10.

The cutting edge components 40, 140, 240, 340, and 440 may also be configured for optimal placement of the material used to form the cutting edge components 40, 140, 240, 340, and 440 to reduce weight, cost, and the amount of throwaway material at the end of life of the cutting edge components 40, 140, 240, 340, and 440. Providing the maximum thickness near the middle portion of the cutting edge components 40, 140, 240, 340, and 440 in the lateral direction may result in a relatively longer wear life. The maximum thickness may be provided below the location of the lower edge of the support surface 36 of the moldboard assembly 34 when the cutting edge component 40, 140, 240, 340, and 440 is mounted to the support surface 36.

As shown in the side views of FIGS. 3, 6, 9, 12, and 16, the mounting portions 50, 250, and 350 may have a smaller thickness (e.g., thickness T1, T2, or T4) compared to the maximum thickness of the cutting edge components 40, 140, 240, 340, and 440. For example, the substantially planar portion 52 of the mounting portion 50, 250, and 350 may taper toward the proximal end of the components 40, 140, 240, 340, and 440 to form the proximal edge 58. Also, the substantially planar portion 52 of the mounting portion 250 and 350 may have a variable thickness (e.g., thickness T2 or T4) that tapers substantially continuously from the distal end toward the proximal edge 58.

In addition, the wear portions 60 and 360 or teeth 160, 260, and 460 may also have a smaller thickness (e.g., thickness T1, T3, or T5) compared to the maximum thickness of the cutting edge components 40, 140, 240, 340, and 440. For example, the substantially planar portion 62 of the wear portions 60 and 360 or teeth 160, 260, and 460 may taper toward the distal end of the components 40, 140, 240, 340, and 440 to form the ground engaging edge(s) 68. Also, the substantially planar portion 62 of the wear portion 360 and teeth 260 and 460 may have a variable thickness (e.g., thickness T3 or T5) that tapers substantially continuously from the proximal end toward the ground engaging edge 68.

As a result of the optimal placement of the material used to form the cuffing edge components 40, 140, 240, 340, and 440, less material may be used to manufacture the cutting edge components 40, 140, 240, 340, and 440, which may lower the cost of manufacturing and may minimize the amount of throwaway material at the end of life. Also, the cutting edge components 40, 140, 240, 340, and 440 may have a relatively lower weight, which may make them easier to handle.

In addition, the cutting edge components 40, 140, 240, 340, and 440 may be formed of cast steel which may reduce the time and cost for manufacturing the cutting edge components 40, 140, 240, 340, and 440 described above and shown in FIGS. 2-18, e.g., compared to rolled steel. Thus, the cutting edge components 40, 140, 240, 340, and 440 including the features described above, such as the mounting portions 50, 250, and 350, the wear portions 60 and 360, the teeth 160, 260, and 460, and/or the ribs 70, may be formed as a single integral and/or continuous part.

It will be apparent to those skilled in the art that various modifications and variations can be made to the disclosed cutting edge components. Other embodiments will be apparent to those skilled in the art from consideration of the specification and practice of the disclosed cutting edge components. It is intended that the specification and examples be considered as exemplary only, with a true scope being indicated by the following claims and their equivalents.

What is claimed is:

1. A wear component for a ground engaging tool, the wear component comprising:

a mounting portion having a first surface, a second surface opposite the first surface, a proximal end, and a thickness between the first surface and the second surface of the mounting portion, the mounting portion being connectable to a mounting assembly of the ground engaging tool, wherein the ground engaging tool includes a support surface having a lower edge, wherein the support surface is positioned in a forward direction and is configured for attachment of the mounting portion to the support surface;

at least one wear portion connected to the mounting portion and forming at least one ground engaging edge, the at least one wear portion having at least one first surface, at least one second surface opposite the at least one first surface, a distal end, and at least one thickness between the at least one first surface and the at least one second surface of the at least one wear portion; and a middle portion being located where the mounting portion and the at least one wear portion connect, wherein the middle portion is adjacent to the lower edge of the support surface when the wear component is attached to the support surface, wherein the at least one wear portion is positioned below the lower edge of the support surface of the ground engaging tool, wherein the second surface of the mounting portion is in contact with the support surface, wherein the first surface of both the mounting portion and the at least one wear portion are positioned in the forward direction, wherein the thickness of the mounting portion excludes the proximal end of the mounting portion, wherein the at least one thickness of the at least one wear portion excludes the distal end of the at least one wear portion, wherein a maximum of the at least one thickness of the at least one wear portion is greater than or equal to a maximum of the thickness of the mounting portion;

wherein the at least one wear portion includes at least one groove extending laterally from the at least one ground engaging edge to the middle portion of the wear component, the at least one groove having a bottom surface that is parallel to the at least one first surface of the at least one wear portion, the groove having at a depth less than or equal to 75% of the maximum of the at least one thickness of the at least one wear portion and the at least one groove having sides connecting the bottom surface to the at least one first surface of the at least one wear portion, and wherein the distal end of the at least one wear portion forms the at least one ground engaging edge with the at least one first surface of the at least one wear portion, the at least one ground engaging edge extending across a width of the groove.

2. The wear component of claim 1, wherein the at least one groove forms self-sharpening edges comprising unworn and sharpened portions of groove edges.

3. The wear component of claim 1, wherein the at least one groove is generally U-shaped.

4. The wear component of claim 1, wherein the at least one groove has a lateral groove length smaller than a lateral length of the at least one wear portion.

5. The wear component of claim 1, wherein the at least one wear portion includes a plurality of the grooves.

6. The wear component of claim 5, wherein the at least one wear portion includes a single wear portion including the plurality of the grooves.

7. The wear component of claim 5, wherein the at least one wear portion includes a plurality of wear portions, and each of the wear portions includes the at least one groove.

8. The wear component of claim 1, wherein the thickness of the mounting portion tapers toward a proximal edge of the mounting portion, and the at least one thickness of the at least one wear portion tapers toward the at least one ground engaging edge.

9. The wear component of claim 1, wherein the maximum of the thickness of the mounting portion is located closer to the at least one wear portion than a proximal edge of the mounting portion; and the maximum of the at least one thickness of the at least one wear portion is located closer to the mounting portion than the respective at least one ground engaging edge.

10. A wear component for a ground engaging tool, the wear component comprising:

a mounting portion having a first surface, a second surface opposite the first surface, a proximal end, and a thickness between the first surface and the second surface of the mounting portion, the mounting portion being connectable to a mounting assembly of the ground engaging tool, wherein the ground engaging tool includes a support surface having a lower edge, wherein the support surface is positioned in a forward direction and is configured for attachment of the mounting portion to the support surface;

at least one wear portion connected to the mounting portion and forming at least one ground engaging edge, the at least one wear portion having at least one first surface, at least one second surface opposite the at least one first surface, a distal end, and at least one thickness between the at least one first surface and the at least one second surface of the at least one wear portion; and a middle portion being located where the mounting portion and the at least one wear portion connect, wherein the middle portion is adjacent to the lower edge of the support surface when the wear component is attached to the support surface, wherein the at least one wear portion is positioned below the lower edge of the support surface of the ground engaging tool, wherein the second surface of the mounting portion is in contact with the support surface, wherein the first surface of both the mounting portion and the at least one wear portion are positioned in the forward direction, wherein the thickness of the mounting portion excludes the proximal end, wherein the at least one thickness of the at least one wear portion excludes the distal end, wherein a maximum of the at least one thickness of the at least one wear portion is greater than or equal to a maximum of the thickness of the mounting portion, wherein at least one groove extending laterally from the at least one ground engaging edge to the proximal end of the at least one wear portion, the at least one groove having a bottom surface that is parallel to the at least one first surface of the at least one wear portion, the groove having at a depth less than or equal to 75% of the maximum of the at least one thickness of the at least one wear portion and the at least one groove having sides connecting the bottom surface to the at least one first surface of the at least one wear portion, wherein a first maximum thickness of the mounting portion decreases substantially continuously from a first end of the mounting portion to a second end of the mounting portion, and wherein a second maximum thickness of the at least one wear portion decreases substantially continuously from at least one first end of the at least one wear portion to the respective at least one ground engaging edge, and wherein the distal end of the at least one wear portion forms the at least one ground engaging edge with the at least one first surface of the at least one wear portion, the at least one ground engaging edge extending across a width of the groove.

11. The wear component of claim 10, wherein the second end of the mounting portion is a proximal edge of the mounting portion, and the first end of the mounting portion connects to the at least one first end of the at least one wear portion.

12. The wear component of claim 10, wherein an average of the second maximum thickness of the at least one wear portion is larger than an average of the first maximum thickness of the mounting portion.

* * * * *